United States Patent [19]

Slanker

[11] Patent Number: 4,632,770

[45] Date of Patent: Dec. 30, 1986

[54] POLYCARBOXYLIC ACID ESTER DRAWING AND IRONING LUBRICANT EMULSIONS AND CONCENTRATES

[75] Inventor: Steven R. Slanker, Naperville, Ill.

[73] Assignee: Nalco Chemical Company, Naperville, Ill.

[21] Appl. No.: 821,368

[22] Filed: Jan. 22, 1986

[51] Int. Cl.[4] ..... C10M 173/00

[52] U.S. Cl. ..... 252/49.5; 252/56 S

[58] Field of Search ..... 252/49.5, 56 S, 56 R

[56] References Cited

U.S. PATENT DOCUMENTS

| | | | |
|---|---|---|---|
| 2,625,509 | 1/1953 | Laug | 252/49.5 |
| 3,213,024 | 10/1965 | Blake et al. | 252/49.5 |
| 4,287,741 | 9/1981 | Peters et al. | 252/49.5 |

*Primary Examiner*—Jacqueline V. Howard

*Attorney, Agent, or Firm*—John G. Premo; Donald G. Epple; Anthony L. Cupoli

[57] ABSTRACT

A water-in-oil emulsion lubricant concentrate useful in drawing and ironing of various metals is described. The active ingredients are a monohydric alcohol ester of polycarboxylic acids. Included in the concentrates are emulsifying agents and optionally, corrosion inhibitors.

6 Claims, No Drawings

POLYCARBOXYLIC ACID ESTER DRAWING AND IRONING LUBRICANT EMULSIONS AND CONCENTRATES

INTRODUCTION

In the fabricating of metal into complex shapes such as the drawing and ironing steps used in producing a can from a sheet of aluminum or steel, a number of different lubricants are involved. Residual oils are present on most sheet surfaces from prior rolling and fabricating operations. An additional process lubricant is used for the drawing operation. A third process lubricant is used for the ironing operation. Finally, a mechanical or hydraulic lubricant associated with the press equipment may become inadvertently mixed with the process lubricants. Normally these lubricants have different compositions although it is known to use the same lubricant in both drawing and ironing operations although at different concentrations.

The ideal drawing and ironing lubricant would have the following properties and characteristics:

A. Improved lubrication, lower use concentration.
B. Cleans easier. It washes off the cans using less washer chemicals.
C. Improved Housekeeping. The equipment and floor areas are significantly cleaner.
D. Improved effluent treatment. Less chemicals and equipment are required to treat the effluent.
E. Reclaimability. Can reclaim material easily using conventional equipment.
F. Reoil lubricant. Can also be employed as a reoiling lubricant for coil stock before the drawing and ironing process.
G. Synthetic machine/hydraulic lubricant. With modifications, can also be employed as the machine/hydraulic lubricant for the equipment in the drawing and ironing process.

THE INVENTION

In its broadest aspect, the invention comprises a concentrate useful for preparing an oil-in-water emulsion lubricant used in the drawing and ironing of ferrous and non-ferrous metals comprising:

| Ingredient | % by weight |
|---|---|
| $C_2$–$C_{10}$ polycarboxylic acid having at least 70% by weight of its carboxylic acid groups esterified with a $C_4$–$C_{30}$ monohydric alcohol | 50–90 |
| Water-in-oil emulsifying agent having a HLB number of at least 8 | .5–30 |
| Polyglycol co-emulsifier | 0–8 |
| Phosphate corrosion inhibitor | .0–3 |
| Copper corrosion inhibitor | 0–2 |

The concentrates of the above type are formed into oil-in-water emulsions by adding them to water. The amount of concentrate in the water may vary between as little as 0.5% up to about 50% by weight. In a preferred embodiment, the amount of concentrate of the finished emulsion ranges between 1–30% by weight.

The lubricants of the invention, while being capable of use in the drawing and ironing of both ferrous and non-ferrous stock, are particularly useful in the ironing and drawing operations performed on aluminum. The amount used is that amount which will provide adequate lubricity, cooling, and the like, for the particular metal working operation in which the lubricant is used.

THE POLYCARBOXYLIC ACID MONOHYDRIC ALCOHOL ESTERS

As indicated, the polycarboxylic acids have at least 70% of their carboxylic acid groups esterified with the monohydric alcohol. Preferably, these acids have 90% up to almost complete esterification of the carboxylic acid groups. In certain instances, minor amounts of unesterified acid groups improve the emulsifiability of the concentrates.

THE CARBOXYLIC ACIDS

While polycarboxylic acids containing between $C_2$–$C_{10}$ or greater atoms may be used, it is preferred to use those containing between $C_4$–$C_{10}$. Two preferred acids are adipic and citric. Illustrative of other such acids are the following:

Oxalic
Malonic
Succinic
Glutaric
Adipic
Pimelic
Suberic
Azelaic
Sebacic
Undecanedioic It is evident from the above that the acids are aliphatic. They may contain elements other than hydrogen and carbon such as OH, Cl, S and the like.

THE MONOHYDRIC ALCOHOLS

The monohydric alcohols contain between $C_4$–$C_{30}$ carbon atoms. Preferably they contain $C_4$–$C_{18}$, with a most preferred being oxo alcohols containing mixtures of $C_6$–$C_{10}$ alcohols. Illustrative of alcohols that may be used are the following:

n-Butyl alcohol
Isobutyl alcohol
sec-Butyl alcohol
tert-Butyl alcohol
n-Amyl alcohol
Isoamylalcohol
tert-Amyl alcohol
sec-Amyl alcohol
Diethylcarbinol
Active amyl alcohol
("d-amyl alcohol)
n-Hexyl alcohol
n-Heptyl alcohol
n-Octyl alcohol
sec-n-Octyl alcohol
N-Nonyl alcohol
n-Decyl alcohol
n-Undecyl alcohol
Lauryl alcohol
Myristyl alcohol
Cetyl alcohol
Stearyl alcohol
Crotyl alcohol
Oleyl alcohol
Citronellol
Geraniol The esters are prepared using conventional esterification procedures which are well-known and need not be described.

Two preferred esters of the $C_6$–$C_{10}$ are oxo alcohol and ester of adipic and citric acid.

THE OIL-IN WATER EMULSIFYING AGENTS

As indicated, these materials are used in the concentrate in amounts between 0.5–30% and preferably 8–20% by weight of the concentrate. While any oil-in-water emulsifying agents may be used, it is desirable that they have an HLB number of at least 8. The HLB system for classifying emulsifying agents is described in detail in the publication "The HLB System", Copyright 1976, ICI Americas, Revised, March, 1980. This publication describes a host of emulsifying agents and mixtures thereof which are capabale of providing oil-in-water emulsions. The disclosure of this publication is incorporated herein by reference.

A preferable class of emulsifying agents are the unsaturated higher fatty acids, specifically oleic acid in the form of its water-soluble salt and most preferably in the form of an amine salt, particularly its isopropanol amine salt.

THE CO-EMULSIFIER

While the high HLB emulsifier described above may be used alone, improved results are afforded by using a water-soluble low molecular weight polyoxyalkylene glycol having a molecular weight below 400. A preferred glycol is diethylene glycol. When used, the polyglycol is used in amounts ranging from 0–8% by weight and preferably 3–6% by weight.

THE FERROUS METAL CORROSION INHIBITOR

To minimize corrosive attack to ferrous metals in contact with the concentrate and the emulsions prepared therefrom, it is desirable that a corrosion inhibitor such as a water-soluble polyphosphate, e.g. hexametaphosphate, or an organic phosphate such as amyl acid phosphate be used. When used, the amounts vary between 0–3%. Preferably, the dosage is 1.5–2% by weight of the concentrate.

THE COPPER CORROSION INHIBITOR

It is also beneficial, but not necessary, to include in the concentrates a corrosion inhibitor for copper and copper alloys. This may be selected from a wide variety of copper inhibitors such as the mercaptobenzotriazole. Tolytriazole represents a preferred copper inhibitor.

When used, the amounts range between 0–2% and preferably 0.5–1.5%.

EVALUATION OF THE INVENTION

To illustrate the invention, the following compositions are set forth below in Table I.

TABLE I

| Ingredients | Composition No. (% by Weight) 1 | 2 | 3 |
|---|---|---|---|
| A. Adipic acid ester of $C_6$–$C_{10}$ oxo alcohol | 77.2 | | 76.2 |
| B. Citric Acid Ester of $C_6$–$C_{10}$ oxo alcohol | | 79.2 | |
| C. Oleic acid | 10 | 10 | |
| D. Isostearic Acid | | | 11.0 |
| E. Mixed Isopropanol Amine | 7.0 | 8.0 | 7.0 |
| F. Amyl Acid Phosphate | 1.0 | 1.0 | 1.0 |
| G. Sodium Tolyltriazole (50% solution in $H_2O$) | 0.8 | 0.8 | 0.8 |
| H. Diethylene Glycol | 4.0 | 1.0 | 4.0 |

These compositions were formulated into dilute aqueous emulsions and allowed to stand. They showed good stability and were acceptable for use in the drawing and ironing of aluminum.

In addition to emulsion stability, they were subject to two different tests which were slight modifications of the lubricating test described in *The Annual Book of ASTM Standards,* published by the American Society for Testing and Materials, 1974, ASTM Designation: D 2714–68 (Reapproved 1973). In one case the lubricant was circulated to the contacting surfaces (test method 1), whereas in the other it was fed from a reservoir (test method 2). The results of these tests for compositions 1, 2 and 3 are set forth in Table II.

In addition to the above two described tests, the lubricants were subject to an additional test described in an article entitled "Moving Film—Stationary Sled Friction Apparatus" by R. G. Quiney and W. E. Boren, published in *Lubrication Engineering,* Vol. 27, No. 8, pg. 254–258, August 1971. The results of this test is set forth below:

| | Composition 1 | Composition 2 | Composition 3 |
|---|---|---|---|
| Coefficient of Friction | | | |
| Room Temperature | 0.09 | 0.09 | 0.12 |
| Aged | 0.11 | 0.12 | 0.12 |
| Corrosion | | | |
| MPY[1] | 0.0 | 0.13 | 0.1 |
| MDD[2] | 0.0 | 1.02 | 0.7 |

[1]Mills per year
[2]Milligrams per square decimeter per day

TABLE II

| | Composition 1 | | Composition 2 | | Composition 3 | |
|---|---|---|---|---|---|---|
| | Emulsion Concentration | Coefficient of Friction | Emulsion Concentration | Coefficient of Friction | Emulsion Concentration | Coefficient of Friction |
| Test Method 2 | 4% | 0.022 | 4% | 0.017 | 4% | 0.022 |
| | 2% | 0.024 | 2% | 0.019 | 2% | 0.018 |
| | 1% | 0.025 | 1% | 0.020 | 1% | 0.008 |
| Test Method 1 | 18# | — | 18# | — | 18# | 0.13/1 |
| | 36# | — | 36# | — | 36# | 0.09/1 |
| | 54# | 0.17/2 | 54# | 0.08/2 | 54# | 0.07/3 |
| | 72# | 0.17/3 | 72# | 0.09/3 | 72# | 0.14/5 |
| | 105# | 0.10/5 | 105# | 0.15/3 | 105# | 0.09/5 |
| | 141# | — | 141# | 0.13/3 | 141# | — |
| | 177# | — | 177# | 0.12/5 | 177# | — |

In addition to the lubricity studies indicating a substantial reduction in coefficient friction, tests panels were coated with dilute emulsions of Compositions 1, 2 and 3 and subject to conventional acid cleaning. Good lubricant removal was achieved in all instances.

Having thus described my invention, it is claimed as follows:

1. A concentrate useful for preparing an oil-in-water emulsion lubricant used in the drawing and ironing of ferrous and non-ferrous metals comprising:

| Ingredient | % by weight |
|---|---|
| Adipic acid having at least 70% by weight of its carboxylic acid groups esterified with a $C_4$–$C_{30}$ monohydric alcohol | 50–90 |
| Water-in-oil emulsifying agent having an HLB number of at least 8 | .5–30 |
| Polyglycol co-emulsifier | 0–8 |
| Phosphate corrosion inhibitor | .0–3 |
| Copper corrosion inhibitor | 0–2 |

2. A concentrate useful for preparing an oil-in-water emulsion lubricant used in the drawing and ironing of ferrous and non-ferrous metals comprising:

| Ingredient | % by weight |
|---|---|
| Adipic acid having at least 70% by weight of its carboxylic acid group esterified with a $C_4$–$C_{30}$ monohydric alcohol | 65–85 |
| Water-in-oil emulsifying agent having an HLB number of at least 8 | 8–20 |
| Polyglycol co-emulsifier | 3–6 |
| Phosphate corrosion inhibitor | 1.5–2 |
| Copper corrosion inhibitor | .5–1.5 |

3. The concentrate of claim 1 or claim 2 wherein the adipic acid is fully esterified, the monohydric alcohol is a $C_6$–$C_{10}$ oxoalcohol, the oil-in-water emulsifier is a water-soluble salt of a fatty acid having at least 12 carbon atoms, and the polyglycol emulsifier is diethylene glycol.

4. A water and oil emulsion which contains between 0.5 up to about 50% by weight of the composition of claim 1.

5. A water and oil emulsion which contains between 0.5 up to about 50% by weight of the composition of claim 2.

6. A water and oil emulsion which contains between 0.5 up to about 50% by weight of the composition of claim 3.

* * * * *